US005259303A

United States Patent [19]

Yamamoto et al.

[11] Patent Number: 5,259,303

[45] Date of Patent: Nov. 9, 1993

[54] RICE CLEANING MACHINE

[75] Inventors: Soichi Yamamoto, Tendou; Haruo Mori, Yamagata, both of Japan

[73] Assignee: Yamamoto & Co., Ltd., Yamagata, Japan

[21] Appl. No.: 995,018

[22] Filed: Dec. 22, 1992

[30] Foreign Application Priority Data

Dec. 27, 1991 [JP] Japan ..... 3-359026

[51] Int. Cl.[5] ..... B02B 3/00; B02B 3/04; B02B 3/06

[52] U.S. Cl. ..... 99/519; 99/524; 99/606; 99/609; 99/611

[58] Field of Search ..... 99/518-520, 99/521, 522, 524, 525, 528, 600-608, 609-611, 612-615, 617, 619, 620, 622; 426/481-483; 51/4, 22, 72 R; 241/86.1, 88.2, 93

[56] References Cited

U.S. PATENT DOCUMENTS

| | | | |
|---|---|---|---|
| 1,424,638 | 8/1922 | Giozza | 99/609 |
| 3,734,752 | 5/1973 | Headley | 426/481 |
| 3,960,068 | 6/1976 | Salete | 99/606 |
| 4,292,890 | 10/1981 | Satete-Garces | 99/611 |
| 4,426,922 | 1/1984 | Yamamoto | 99/524 |
| 4,459,903 | 7/1984 | Yamamoto | 99/611 |
| 4,800,810 | 1/1989 | Masumoto | 99/519 |
| 4,843,957 | 7/1989 | Satake | 99/617 |
| 4,913,045 | 4/1990 | Satake | 99/606 |
| 5,048,407 | 9/1991 | Salete-Garces | 99/519 |
| 5,119,721 | 6/1992 | Satake et al. | 99/519 |

FOREIGN PATENT DOCUMENTS

| | | |
|---|---|---|
| 47652 | 1/1972 | Japan . |
| 182041 | 7/1988 | Japan . |

*Primary Examiner*—Timothy F. Simone
*Attorney, Agent, or Firm*—Browdy and Neimark

[57] ABSTRACT

A rice-cleaning machine has a flowing-down friction type rice-cleaning chamber (18) formed around the lower portion of a main vertical rotary shaft (10) a grain sending chamber (79) formed around an upper portion of the main shaft (10) for forcibly sending grains to the rice-cleaning chamber (18), and a rising-up abrasion type rice-cleaning chamber (44) formed around the grain sending chamber (79). Rice-cleaning rolls (15) and (38) of the rice-cleaning chambers (18) and (44) are independently driven to rotate. A grain overflow port at an upper portion of the abrasion cleaning chamber (44) and a grain flowing-in port at an upper portion of the grain sending chamber (79) are communicated through by a connection passage (61). A rice grain supply apparatus consisting of a vertical cylinder body (46) and a vertical spiral (49) are connected to a side portion of the abrasion chamber (44).

7 Claims, 6 Drawing Sheets

86
73
74
75
46
49
48
50
55
16
58
66
67
56
43
38
33
37
36
31
19
15
21
17
83
2
27
21
80
81
1
20
68
69
70
71
72
12
8
13
9
11
6
2
7
3
14
4
10
9

RICE CLEANING MACHINE

FIELD OF THE INVENTION

The present invention relates to a rice-cleaning machine, in particular, relates to a rice-cleaning machine for continuously performing both abrasion cleaning operation and friction cleaning operation by a single machine.

DESCRIPTION OF THE PRIOR ART

The conventional rice-cleaning machine can be categorized as abrasion type machines and friction type machines. The abrasion type machine is provided with a rice-cleaning roll having a file-like surface made of emery stone for abrasing outer skin or bran of rice grains. On the other hand, the friction type machine is provided with a steel rice-cleaning roll having around four protrusions or ridges for causing rice grains to be frictionally moved each other so as to remove rice bran.

The above both types of the rice-cleaning machines have respective features and are used in accordance with their applications. Conventionally, both types of machines have been used in such a way that first the abrasion type machine carries out an initial cleaning of rice and then the friction type machine carries out finish cleaning of initially abraded rice. As a result, a reasonable effect has been achieved.

However, when these two rice-cleaning methods are used, since two or several machines are arranged in row and linked with conveyers and/or elevators, they appear like a small industrial complex and thereby raises the overall cost.

Another type of rice-cleaning machine having both an abrasion roll and a friction roll which are mounted to a single rotating shaft for continuously performing an abrasion operation and a friction operation has been proposed in Japanese Patent Publication No. Sho 47-652.

It is of course that when two types of rolls are mounted to a single rotating shaft, some accessaries of conveyers and elevators can be omitted making the whole construction of the rice-cleaning machine small and low in manufacturing cost. However, the rotation speeds of both rolls are made same due to a single common shaft. In general, the friction roll is preferably rotated in a peripheral speed of less than 600 feet/min and the abrasion roll in a peripheral speed of more than 1500 feet/min. Thus, it is difficult to operate these two types of rolls with one common shaft.

In addition, each of abrasion type machine and friction type machine can be categorized as a vertically positioned type where the rice-cleaning roll is vertically arranged and a horizontally positioned type where the roll is horizontally arranged. Moreover, the vertically positioned type can be also categorized as a flow down-type where rice grains are supplied to a top side of the roll and discharged from a bottom side of the roll and a rising-up type where rice grains are supplied to a bottom side of the roll and discharged from a top side of the roll.

As described above, there are many types of rice-cleaning machine. As one key point to be considered for selecting the construction of the rising up and abrasion type rice-cleaning machine, it is necessary to consider a method for supplying rice grains to the abrasion rice-cleaning chamber.

Conventionally, a rice grain hopper is provided on a side of the rice-cleaning chamber and rice grains are supplied to the rice-cleaning chamber by their dead weight. However, it is clear that such arrangement has a difficulty in supply flowing of rice grains, such as clogging of rice grains in a conduct.

To prevent such a problem, Japanese Patent Laid-Open Publication No. Sho 63-182041 discloses a rice-cleaning machine provided with a rice supply apparatus consisting of a cylindrical body transversely extending from a rice-cleaning chamber and a horizontal screw conveyor installed in the cylindrical body, so as to stably supply rice grains to the rice-cleaning chamber.

However, since the rice supply apparatus above is adapted to forcibly push rice grains to the rice-cleaning chamber in a horizontal direction by means of the screw conveyor, the pressure or force is excessively high and thereby rice grains are sometimes broken. In addition, the transversal size of the cylindrical body is made big and it is troublesome to handle it.

SUMMARY OF THE INVENTION

Accordingly, it is the purpose of the present invention to provide a rice-cleaning machine enabling to continuously carry out an abrasion type rice-cleaning operation and a friction type rice-cleaning operation by a single machine with characteristics of both the types of the rice-cleaning operations.

It is another purpose of the present invention to provide a rice-cleaning machine having a vertical rice supply cylinder for smoothly supply a suitable volume of rice grains to an abrasion type rice-cleaning chamber.

DETAILED EXPLANATION OF PREFERRED EMBODIMENT

Figure 1:
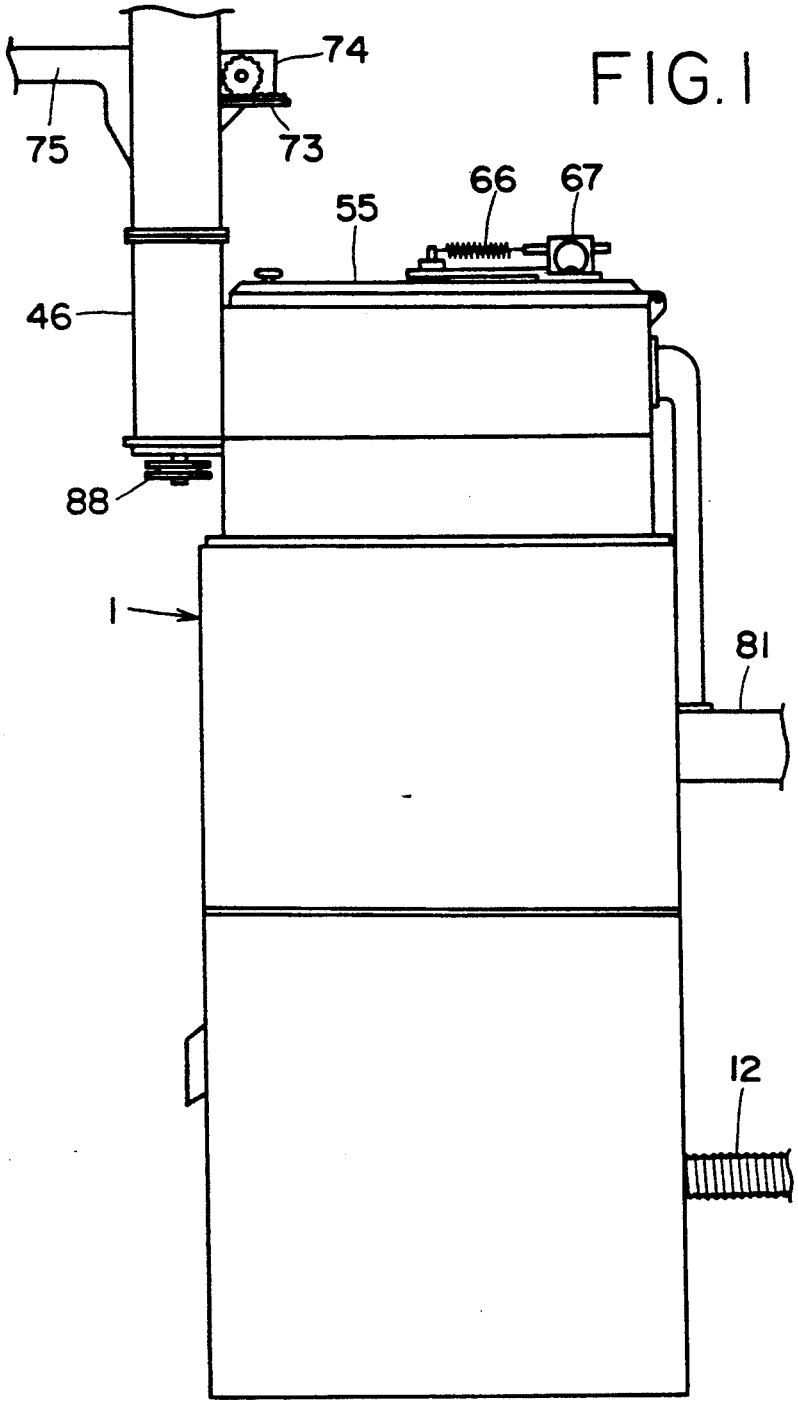
FIG. 1 is a side elevation showing an appearance of the rice-cleaning machine according to the present invention.

An embodiment of the rice-cleaning machine of the present invention will be explained with reference to the drawings. The rice-cleaning machine installed on a floor has a outside case 1, which is formed by securing thin iron sheet around an outer periphery of the frame 2 and has a whole shape of vertical long box.

The outside case 1 has a horizontal partition 3 formed in a bottom interior space thereof, and a lower transmission room 4 is formed under the horizontal partition 3. A vertical through hole is formed at a center of the horizontal partition 3, through which hole a lower end of a vertical fixing cylinder 6 is inserted, and a nut 7 is fixedly threaded on the lower end. A flange-like supporting stand 8 is formed at a top end of the vertical fixing cylinder 6. Within the cylinder 6, there is a main hollow vertical rotary shaft 10 supported by two pairs of upper and lower bearings 9. A blowing pipe 12 connected to a blower (not shown) is secured to an outer wall of the cylinder 6. Wind is supplied from the pipe 12 to a chamber 11 between the main rotary shaft 10 and the cylinder 6 and then sent to the interior of the main rotary shaft 10 through a slit 13 formed in the outer wall of the shaft 10.

Figure 3:
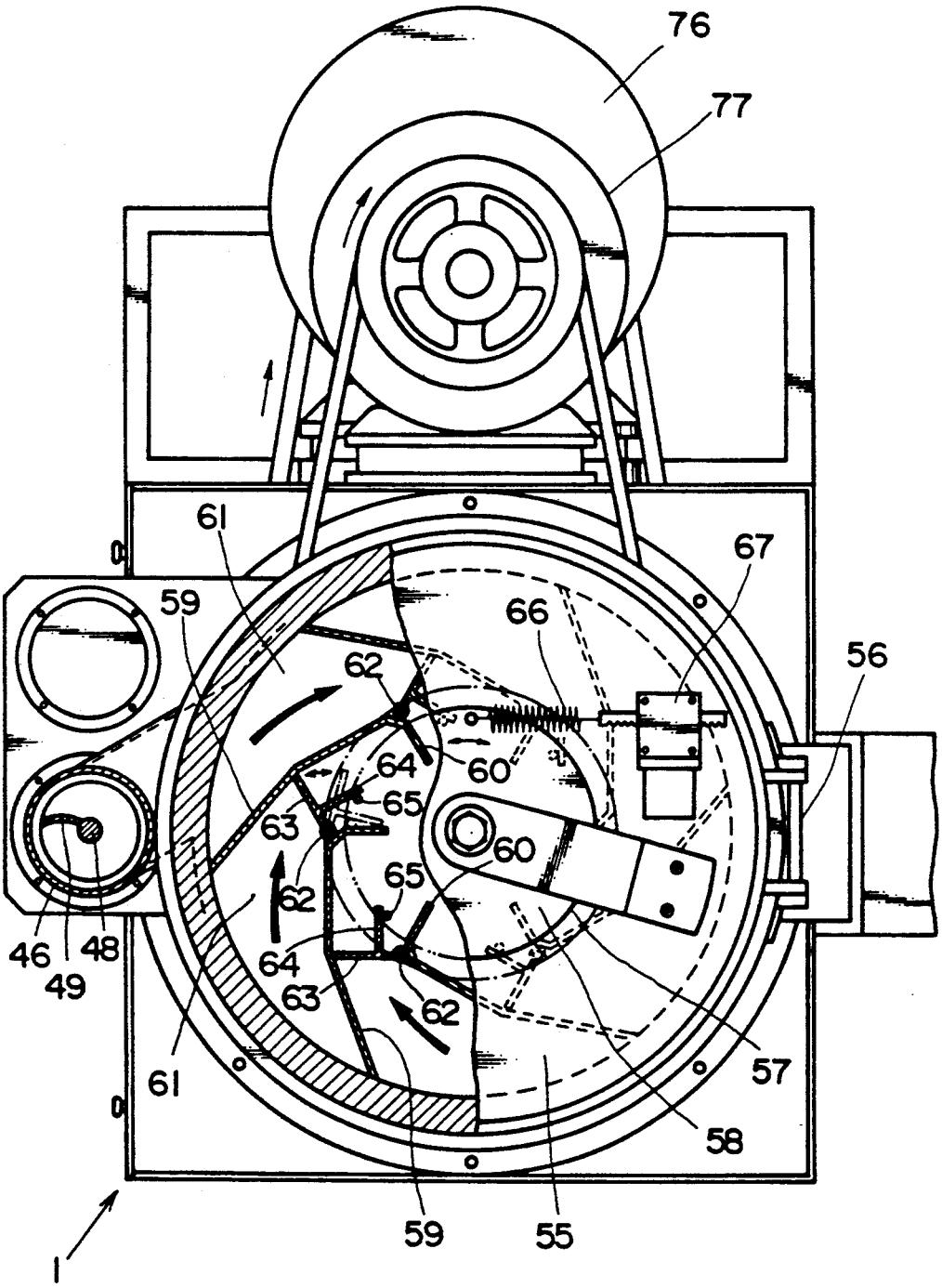
FIG. 3 is a partly broken plan view of the rice-cleaning machine.

To a lower end of the main vertical rotary shaft 10 projecting down lower than the horizontal partition 3, a driven pulley 14 placed in the lower transmission room 4 is secured. The driven pulley 14 is driven by a main motor 76 arranged as seen in FIG. 3.

The top end of the vertical rotary shaft 10 protrudes upward through two different horizontal partitions 19 and 20. On the outer wall or circumference of a part of the main rotary shaft 10 between the two horizontal partitions 19 and 20, a friction type rice-cleaning roll 15 provided with ridges 80 is inserted from above and secured thereto.

Figure 5:
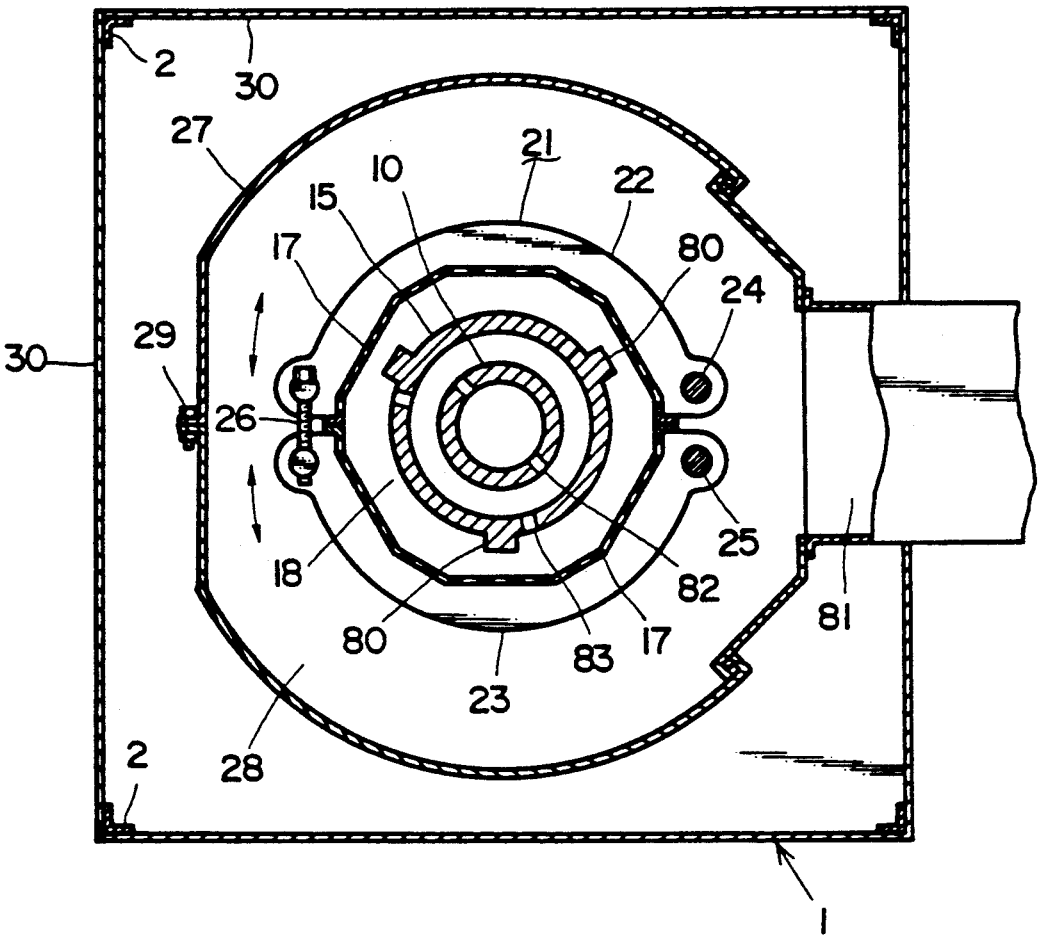
FIG. 5 is a transversal and sectional plan view of the flowing-down type friction rice-cleaning chamber of the machine.

The friction type rice-cleaning roll 15 is surrounded by a polygon rice-cleaning cylinder 17 made of a perforated sheet so as to form a friction rice-cleaning chamber 18 between the rice-cleaning roll 15 and the rice-cleaning cylinder 17 as shown in FIG. 5. A top or upper portion of the friction type rice-cleaning chamber 18 functions as a rice flowing-in side and a lower portion thereof functions as a rice flowing-out side. Therefore, the friction type rice-cleaning chamber 18 is said of a flowing-down type.

The rice-cleaning cylinder 17 has a half-divided structure and respective halves are held by a frame 21. The frame 21 consists of a pair of arc-shape arms 22 and 23. Respective ends of the arc-shape arms 22 and 23 are rotatably journalled with the frame 2 through pins 24 and 25. Other ends of the arms 22 and 23 are joined together by a screw 26. In order to exchange the rice-cleaning cylinders 17, the screw 26 is loosen and removed opening the halves 22 and 23 of the frame 21 to the left and the right.

An intermediate wall 27 enclosing the frame 21 and surrounding it in a manner of about cocentricity. The interior of the intermediate wall 27 is a sucking room or space 28 to which a sucking blower (not shown) is connected through a passage 81. Wind flown into the main rotary shaft 10 through the slit 13 is blown toward the rice-cleaning chamber 18 through a slit 82 of the main rotary shaft 10 and another slit 83 of the rice-cleaning roll 15 in order to sweep rice-bran deposited in the rice-cleaning chamber 18 out of a hole of the rice-cleaning cylinder 17 into the sucking room 28. Rice-bran swept out into the sucking room 28 is discharged through the passage 81. When the rice-cleaning cylinders 17 are exchanged, the intermediate wall 27 is obstacle or hindrance to do such work, so the screw 29 is made loose and the intermediate wall 27 is separated to the left and the right.

Figure 2:
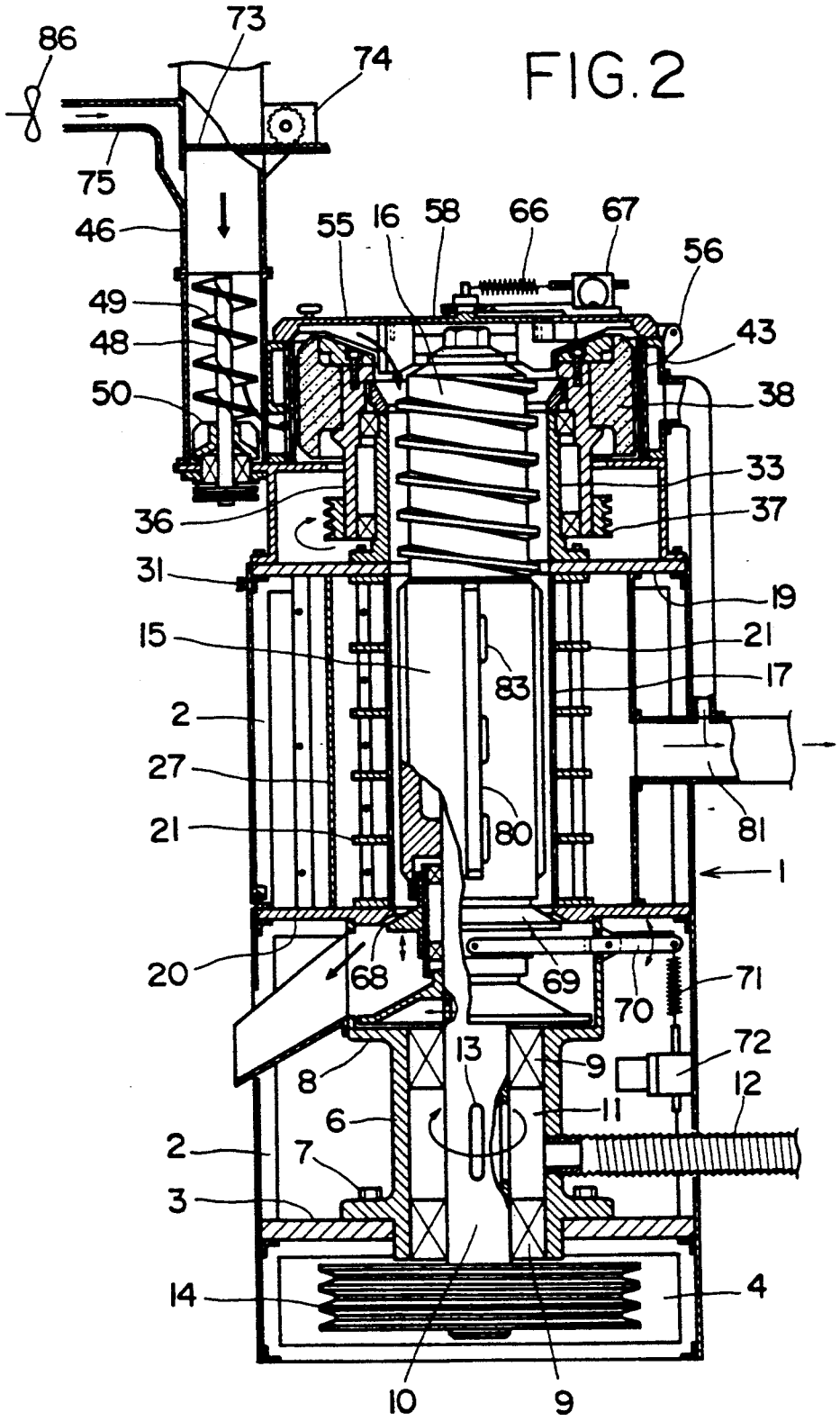
FIG. 2 is an axial sectional side elevation of the rice-cleaning machine shown in FIG. 1.

As shown in FIG. 2 and FIG. 5, a part 30 of the outside case 1 made of thin iron plate is removable by a screw 31.

A grain sending screw 16 is inserted on and secured to the main vertical rotary shaft 10 protruding upward through the through hole 32 of the horizontal partition 19. The grain sending screw 16 and the rice-cleaning roll 15 can be removed from the main rotary shaft 10 after they are pulled up. The grain sending screw 16 is adapted to forcibly send rice grains to the lower rice-cleaning chamber 18. The grain sending screw 16 is surrounded by a grain sending cylinder 33 leaving a predetermined distance or space between them, which is used as a grain sending chamber 79. The grain sending cylinder 33 is secured as shown in FIG. 4 to the horizontal partition 19 by means of screws 78.

The grain sending cylinder 33 is shorter in height than the grain sending screw 16, and has a funnel 34 secured to a top of the grain sending cylinder 33. A rotary cylinder 36 is attached to the outer wall of the grain sending cylinder 33 through two pairs of upper and lower bearings 35. A driven pulley 37 is secured to the lower outer wall portion of the rotary cylinder 36. The driven pulley 37 is driven by a subsidiary motor 77. An abrasion type rice-cleaning roll 38 having a file-like surface fits onto the top circumference of the rotary cylinder 36. Because the driven pulley 37 is placed at a position higher than that of the horizontal partition 19, the driven pulley 37 doesn't obstruct exchanging operations of the rice-cleaning cylinder 17.

Figure 4:
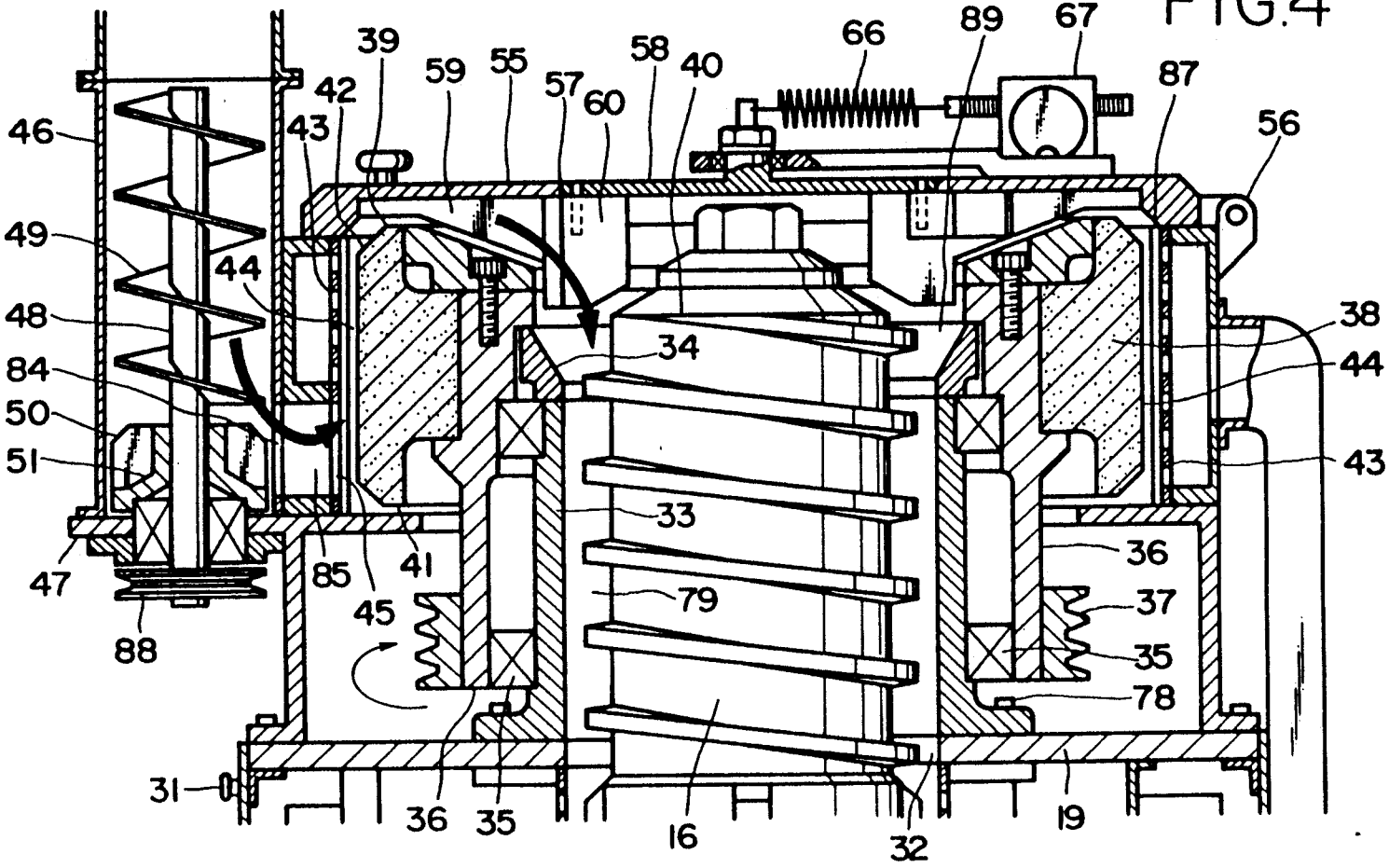
FIG. 4 is an enlarged axial sectional side elevation of the upper portion of the rice-cleaning machine.

As shown in FIG. 4, the abrasion rice-cleaning roll 38 has a ring-like construction of a short in height. A top edge 39 of the rice-cleaning roll 38 is placed somewhat above the top edge 40 of the grain sending screw 16. A lower edge 41 of the rice-cleaning roll 38 is placed at an intermediate position between these top and bottom ends of the grain sending screw 16. The rice-cleaning roll 38 has a slanted portion 42 formed on its top edge 40. A rice-cleaning cylinder 43 made of a perforated plate surrounds the rice-cleaning roll 38 leaving a predetermined gap or distance between them. The space between the abrasion type rice-cleaning roll 38 and the rice-cleaning cylinder 43 is used an abrasion type rice-cleaning chamber 44. As will be described, the abrasion type rice-cleaning chamber 44 has a lower rice flowing-in port and an upper rice discharging port, so that the abrasion type rice-cleaning chamber 44 is of a rice flowing-up type through which chamber rice grains are upwardly raised.

Figure 6:
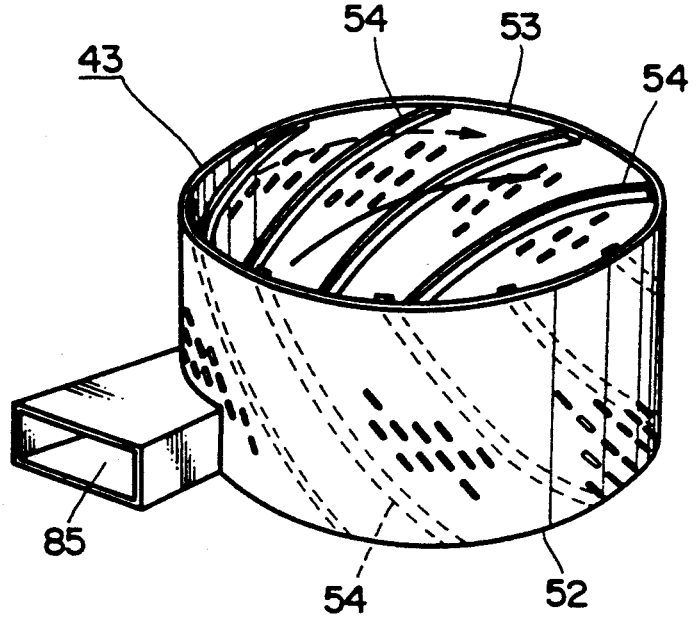
FIG. 6 is a perspective view of a rice-cleaning cylinder of a rising-up abrasion rice-cleaning chamber.
Figure 7:
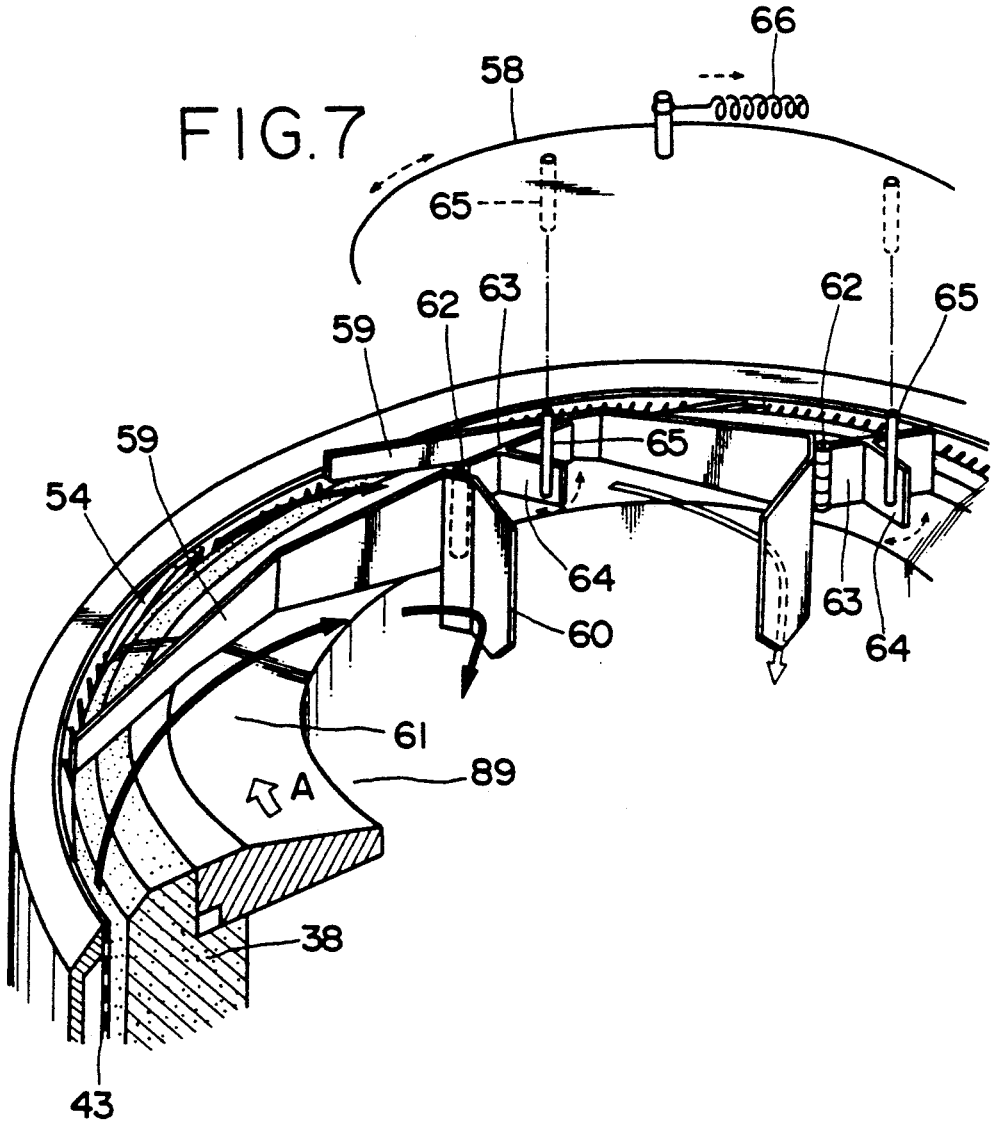
FIG. 7 is a perspective view of a connection route from the rising-up type abrasion rice-cleaning chamber to a flowing-in port of a hull sending chamber.

As shown in FIG. 6, the rice-cleaning cylinder 43 has a rice flowing-in port 45 formed at a corner of the lower portion of the rice-cleaning cylinder 43. Helical member 54 are placed in an interior of the rice-cleaning cylinder 43 so as to extend from its lower edge 52 to its upper edge 53. According to the embodiment of the present invention, nine helical members are formed at a regular interval on the interior wall of the rice-cleaning cylinder 43. Rice grains supplied to the abrasion-type rice-cleaning chamber 44 through the flowing-in port 45 are guided while being cleaned upwardly by the members 54, overflown from the top edge 39 of the rice-cleaning roll 38, and supplied to the rice sending chamber 79 through a connection passage 61.

A lower end of the cylinder body 46 of the rice grain supply apparatus is closed by a bottom wall 47. The cylinder body 46 has a vertical rotary shaft 48 provided with a screw blade 49. A lower end of the rotary shaft 48 extends through the bottom wall 47 and a pulley 88 is secured the extended end of the rotary shaft 48. The pulley 88 is driven by a motor (not shown). The cylinder body 46 has a rice grain discharge port 84 formed at its portion facing the flowing-in port 45 of the rice-cleaning cylinder 43. The discharge port 84 and the flowing-in port 45 are connected by a passage 85 of substantially horizen. The rotary shaft 48 has a pushing-in blade 50 formed at a position facing the discharge port 84 in stead of the screw blade 49. The pushing-in blade 50 has a mounting boss 51. The top ends of the rotary shaft 48 and the screw blade 49 are free, so that as shown in FIG. 1 they don't have any journal means spreading the cylinder body 46. It is preferable to supply rice grains without force.

A horizontal lid 55 is provided to cover the rice-cleaning cylinder 43, the abrasion type rice-cleaning roll 38, and the grain sending screw 16. The horizon lid 55 is open and shut through a hinge mechanism 56. The horizon lid 55 has a plan shape of right circle and a central round hole 57 having a diameter substantially identical with that of the grain sending cylinder 33. The central round hole 57 has a rotatable small disc 58 of right circle (see FIGS. 3 and 4). The small disc 58 is constantly urged to rotate clockwise in FIG. 3 by means of a spring 66. Resilient force of the spring 66 is adjusted by a motor 67.

Guiding plates 59 of about six are fixed to a bottom face of the horizon lid 55 so as to face from an outer edge of the lid 55 to an outer edge of the round hole 57. In general, the guiding plates 59 are placed in the tangent direction to the round hole 57 and to have an angle of sweepback to a rotation direction A of the abrasion type rice-cleaning roll 38. Bent pieces 60 bent substantially at a right angle facing a center of the lid 55 are formed on the inner edge of the guiding plates 59. The bent pieces 60 are placed above the flowing-in port 89 of the grain sending chamber 79. Rice grains overflown from the abrasion type rice-cleaning chamber 44 are guided by a connection passage 61 partitioned by each guiding plate 59, and supplied to a ring-like funnel 34 of the grain sending chamber 79. Resistance plates 63 are formed on final end portions of the connection passage 61 and journalled with a lower face of the lid 55 by shafts 62. Each resistance plate 63 has arm 64 enabling to contact with each protrusion 65 planted on the small disc 58. When there is no grain in the connection passage 61, the resistance plates 63 are pressed through the protrusions 65 urged by the spring 66, thereby the connection passage 61 is as shown in FIG. 3 closed. On the contrary, when much rice is flown into the connection passage 61, the passage 61 opens according to relation of the grain pressure and resilient force of the spring 66.

As shown in FIG. 2, the lower portion of the friction type rice-cleaning chamber 18 has a ring-like flowing-out port 68 provided with a resistance valve 69 adapted to elevate controlling the size of the flowing-out port 68. A supporting arm 70 is journalled with the resistance valve 69 through its one end, a spring 71 pulls downward another end of the supporting arm 70, and a motor 72 controls resilient force of the spring 71.

A valve 73 is provided on the top portion of the cylinder body 46 in order to control rice supply volume. A motor 74 functions the control valve 73, a remaining rice blowing pipe 75 blows sending remaining rice left in the cylinder body 46, a fun 86 sends wind to the remaining rice blowing pipe 75, and a slanted corner portion 87 prevents rice grains from being accumulated at the corner.

As shown in FIG. 3, the main motor 76 for driving the lower driven pulley 14 and the subsidiary motor 77 for driving the upper driven pulley 37 are placed on one side of the case 1 and piled on the other.

OPERATION OF THE INVENTION

When the main rotary shaft 10 is driven by the main motor 76 through the lower driven pulley 14, the friction type rice-cleaning roll 15 and the grain sending screw 16 rotate and when the subsidiary motor 77 drives the rotary cylinder 36 through the upper driven pulley 37, the abrasion type rice-cleaning roll 38 rotates. Because the friction type rice-cleaning roll 15 and the abrasion type rice-cleaning roll 38 are independently driven and rotate by different motors 76 and 77 as described above, these rolls can be controlled separately to their most effective and suitable speeds.

Accordingly, when other motor (not shown) rotates the pulley 88 and the motor 74 opens the valve 73, rice grains drop into the cylinder body 46 of the rice grain supply apparatus, sent downward by the screw blade 49, and supplied into the abrasion type rice-cleaning chamber 44 by rotation of the pushing-in blade 50 through a substantially horizontal passage 85. Because the cylinder body 46 extends vertically, not horizontally as that of the convention cylinder body, rice grains are smoothly and softly supplied to the rice-cleaning chamber 44.

Rice grains flown in the abrasion type rice-cleaning chamber 44 are abrasively cleaned and raised smoothly through the rice-cleaning chamber 44, since the pushing-in blade 50 forcibly supplies grains continuously and succeedingly, a plurality of helical members 54 for upward leading rice grains in the rice-cleaning chamber 44 are formed on the inner face of the rice-cleaning cylinder 43, and the up-and-down width of the abrasion type rice-cleaning roll 38 is short.

Rice grains initially cleaned in the abrasion type rice-cleaning chamber 44 are flown into the connection passage 61 partitioned by the guide plates 59. While rice grains in the upper space of the abrasion type rice-cleaning chamber 44 are apt to attach to the outer wall of the horizontal lid 55 placed on the upper portion of the rice-cleaning chamber 44 by centrifugal force, the slanted corner 87 formed at the circumference of the horizontal lid 55 guides grains overflown from the rice-cleaning chamber 44 to the connection passage 61.

Because that the resistant plates 63 are placed at the final ends of respective connection passages 61 partitioned by the guide plates 59 and the resistant plates 63 are urged in a direction closing the connection passage 61 by resilient force of the spring 66 functioning through the small disc 58 and protrusions 65, the initially cleaned rice grains are deposited in the connection passage 61 and the volume gradually increases. When the predetermined volume of rice grains are collected in the connection passage 61, a pressure or weight of the collected grains opens the resistant plates 63 against resilient force of the spring 66. Consequently, rice grains are flown little by little or gradually in the rice sending chamber 79, sent downward by rice grain sending screw 16 into the friction type rice-cleaning chamber 18 in which rice is finished in cleaning. Finishing degree or level of rice in the friction type rice-cleaning chamber 18 is controlled by force of the spring 71 controlled by the motor 72.

After a rice-cleaning operation, a small volume of rice grains is remained in the cylinder body 46, and the remaining rice grains are throughly blown into the rice-cleaning chamber 44 by wind blown from the fan 86 to the cylinder body 46 through a remaining rice blowing pipe 75.

It is noted that a rotary cylinder 36 is provided around the main rotary shaft 10 obtaining a double-shaft construction, so that a whole size of the rice-cleaning machine according to the present invention becomes small, notwithstanding the particular construction of separately rotating friction type rice-cleaning roll 15 and the abrasion type rice-cleaning roll 38.

EFFECT OF THE INVENTION

According to the present invention, it is apparent that one rice-cleaning machine of a small size and a low cost can continuously carry out abrasion type rice-cleaning and friction type rice-cleaning operations without characteristics of abrasion type rice-cleaning and friction type rice-cleaning. In addition, suitable volume of rice grains can be with problem supplied to the abrasion type rice-cleaning chamber 44, and rice grains in the abrasion type rice-cleaning chamber 44 can smoothly rises through the rice-cleaning chamber 44.

What is claimed is:

1. A rice-cleaning machine comprising:

a flowing-down friction type rice-cleaning chamber formed between a friction type rice-cleaning roll fixed at a lower portion of a vertical main rotary shaft and a first rice-cleaning cylinder surrounding an outer periphery of said friction type rice-cleaning roll leaving a predetermined distance;

a rice grain sending chamber formed between a grain sending screw thread fixed at an upper portion of the main rotary shaft and a grain sending cylinder surrounding an outer periphery of said grain sending screw thread leaving a predetermined distance so as to send rice grains to the friction type rice-cleaning chamber;

a rotary cylinder rotatably surrounding an outer periphery of the grain sending cylinder;

a rising-up abrasion type rice-cleaning chamber formed between an abrasion type rice-cleaning roll fixed onto an outer periphery of said rotary cylinder and a second rice-cleaning cylinder surrounding an outer periphery of said abrasion type rice-cleaning roll leaving a predetermined distance; and a connection passage formed between a grain overflow port formed at an upper portion of the abrasion type rice-cleaning chamber and a flowing-in port formed at an upper portion of the rice grain sending chamber.

2. The rice-cleaning machine according to claim 1, wherein helical members are formed on an inner face of the second rice-cleaning cylinder of the abrasion type rice-cleaning chamber for upward leading rice grains which moves, by rotation of the abrasion type rice-cleaning roll, within said abrasion type rice-cleaning chamber.

3. The rice-cleaning machine according to claim 1, further comprising a vertical cylinder body placed by a side of the abrasion type rice-cleaning chamber, said vertical cylinder body having a closed bottom and a vertical rotary shaft, a grain discharge port at a side of the lower portion of the cylinder body being communicated with a grain inlet port at a side of the lower portion of the abrasion type rice-cleaning chamber, a push-in blade fixed at the lower end of the rotary shaft and facing said grain discharge port of the cylinder body, and spiral blades fixed to the rotary shaft above said push-in blade so as to move grains downward.

4. The rice-cleaning machine according to claim 3, wherein a blowing pipe led to a blowing fan is connected to the vertical cylinder body.

5. The rice-cleaning machine according to claim 1, further comprising a plurality of guiding plates radially arranged in the connection passage and having a sweep-back to a rotary direction of the abrasion type rice-cleaning roll, thereby rice grains overflown from the grain overflow port of the abrasion type rice-cleaning chamber are gradually guided by said guiding plates toward the flowing-in port of the rice grain sending chamber.

6. The rice-cleaning machine according to claim 5, wherein the inner ends of the guiding plates, respectively are bent inwardly about 90° in order to make them bent pieces and these bent pieces are placed above the flowing-in port of the rice grain sending chamber.

7. The rice-cleaning machine according to claim 6, wherein the connection passage has a resistant plate opening and shutting the connection passage according to pressure of rice grains.

* * * * *